US005975362A

United States Patent [19]

West

[11] Patent Number: 5,975,362

[45] Date of Patent: Nov. 2, 1999

[54] TOOTHPASTE DISPENSER

[76] Inventor: Bruce D. West, 268 Camelot Dr., St. Charles, Mo. 63304

[21] Appl. No.: 09/127,746

[22] Filed: Aug. 3, 1998

[51] Int. Cl.[6] ..... B65D 35/28

[52] U.S. Cl. ..... 222/102; 222/113; 222/192

[58] Field of Search ..... 222/102, 113, 222/192, 333, 181.3

[56] References Cited

U.S. PATENT DOCUMENTS

| | | | |
|---|---|---|---|
| 3,074,598 | 1/1963 | Barton . | |
| 3,241,721 | 3/1966 | Freeman . | |
| 4,213,542 | 7/1980 | Wilson . | |
| 4,220,260 | 9/1980 | Webster . | |
| 4,234,104 | 11/1980 | Apuzzo, Jr. et al. . | |
| 4,258,864 | 3/1981 | Karamanolis et al. . | |
| 4,403,714 | 9/1983 | Kane . | |
| 4,421,252 | 12/1983 | Ylitalo . | |
| 4,629,095 | 12/1986 | Smith . | |
| 5,048,725 | 9/1991 | Peterson . | |
| 5,050,773 | 9/1991 | Choi . | |
| 5,203,473 | 4/1993 | Willey . | |
| 5,248,061 | 9/1993 | Weiselfish et al. . | |
| 5,255,822 | 10/1993 | Mease et al. | 222/113 X |
| 5,421,486 | 6/1995 | Simmons . | |
| 5,449,092 | 9/1995 | Bazan . | |

*Primary Examiner*—Gregory L. Huson
*Attorney, Agent, or Firm*—Haverstock, Garrett & Roberts

[57] ABSTRACT

Apparatus operable for dispensing toothpaste from an outlet opening at one end of a collapsible toothpaste containing tube is disclosed. The present apparatus includes a base member having a nozzle mounted adjacent a first end. The nozzle is adapted for cooperatively receiving and holding the one end of the collapsible toothpaste tube and has a passage therethrough for dispensing toothpaste from the tube. A pinch roller assembly is mounted to the base member for movement therealong between a location spaced from the nozzle and a location adjacent the nozzle, the pinch roller assembly including a pair of pinch rollers defining a space therebetween adapted for receiving the toothpaste tube in a generally collapsed condition. The outer surface of at least a first of the pinch rollers is adapted for engaging the tube so as to be capable of moving along the tube when rotated. The apparatus further includes a drive cable having one end attached to the first pinch roller for drivingly rotating it, the drive cable having an opposite end connected in rotatably driven communication with a gear motor or other rotatable power source. In operation, the rotatable power source is energizable for rotatably driving the drive cable and the connected pinch roller to move the pinch roller assembly along the toothpaste tube for collapsing a portion of the tube to pressurize the toothpaste therein and dispense the toothpaste through the nozzle.

10 Claims, 6 Drawing Sheets

TOOTHPASTE DISPENSER

The present invention relates generally to apparatus for dispensing toothpaste from a tube, and more particularly to a toothpaste dispensing apparatus which utilizes a pinch roller assembly operably connected by a drive cable in rotatably driven communication with a gear motor or other rotatable power source for dispensing the toothpaste from the tube.

BACKGROUND

A wide variety of both manually operable and powered devices for dispensing toothpaste from a tube are well known in the art.

However, all of the known toothpaste dispensing devices utilize mechanisms for pinching or squeezing the toothpaste tube to collapse it, which mechanisms are observed to be too complex and/or too expensive to manufacture for widespread marketability. See, for example, Wilson U.S. Pat. No. 4,213,542 and Kane U.S. Pat. No. 4,403,714.

Accordingly, the present invention is directed to overcoming one or more of the problems as set forth above.

SUMMARY OF THE INVENTION

According to one aspect of the present invention, a simpler and less expensive apparatus operable for dispensing toothpaste from an outlet opening at one end of a collapsible toothpaste containing tube is disclosed. The present apparatus includes a base member having a nozzle mounted adjacent a first end. The nozzle is adapted for cooperatively receiving and holding the one end of the collapsible toothpaste tube and has a passage therethrough for dispensing toothpaste from the tube. A pinch roller assembly is mounted to the base member for movement therealong between a location spaced from the nozzle and a location adjacent the nozzle, the pinch roller assembly including a pair of pinch rollers defining a space therebetween adapted for receiving the toothpaste tube in a generally collapsed condition. The outer surface of at least a first of the pinch rollers is adapted for engaging the tube so as to be capable of moving along the tube when rotated. The apparatus further includes a drive cable having one end attached to the first pinch roller for drivingly rotating it, the drive cable having an opposite end connected in rotatably driven communication with a gear motor or other rotatable power source. In operation, the rotatable power source is energizable for rotatably driving the drive cable and the connected pinch roller to move the pinch roller assembly along the toothpaste tube for collapsing a portion of the tube to pressurize the toothpaste therein and dispense the toothpaste through the nozzle.

DETAILED DESCRIPTION OF THE PREFERRED EMBODIMENTS OF THE INVENTION

Figure 1:
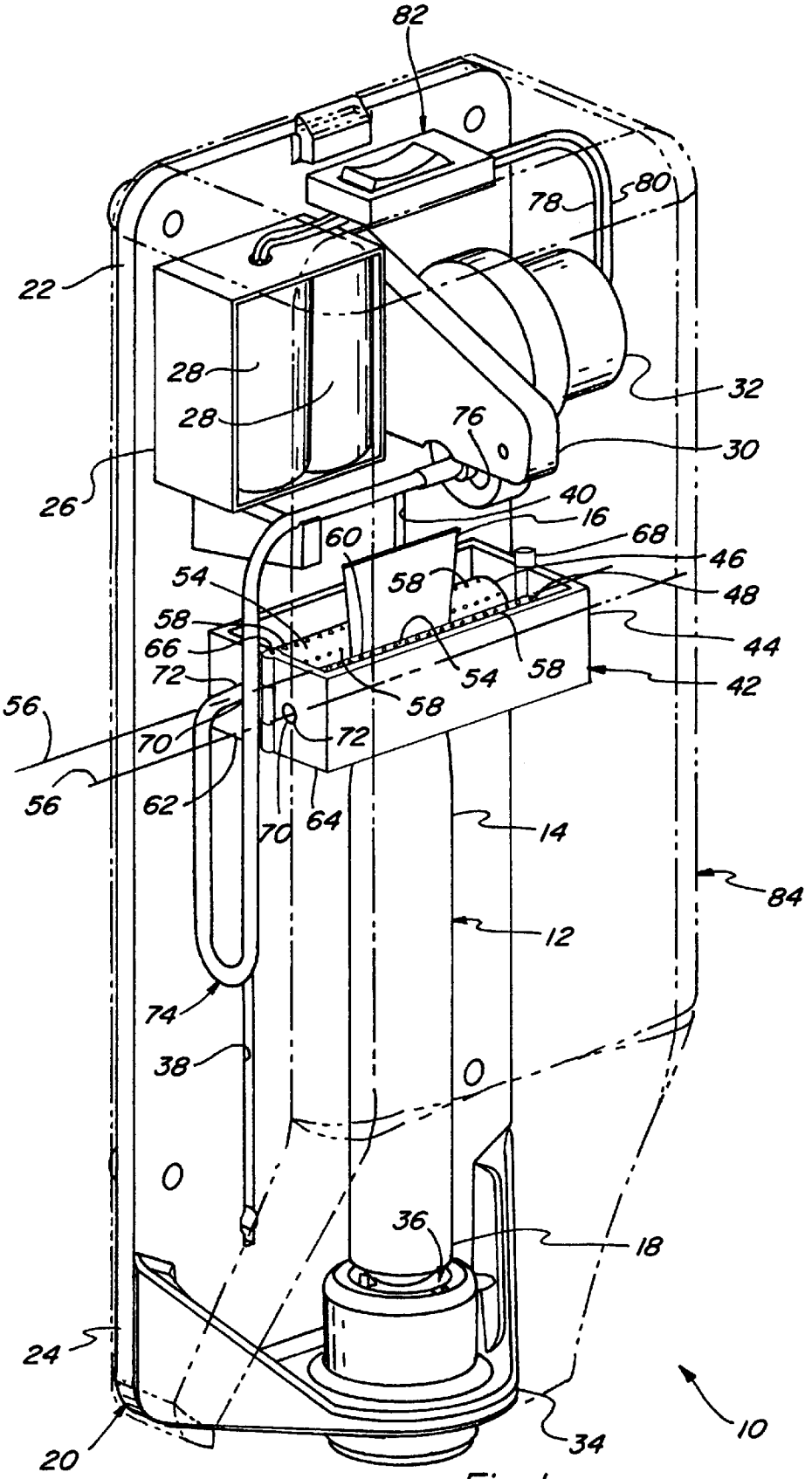
FIG. 1 is a perspective view of apparatus for dispensing toothpaste according to the present invention including a cover member thereof shown in phantom to reveal a base member, a nozzle, a pinch roller assembly, and a drive assembly thereof, for dispensing toothpaste from a prior art toothpaste tube shown in association therewith.

Referring now to the drawings more particularly by reference numbers, wherein like numerals refer to like parts, the number 10 in FIG. 1 refers to apparatus for dispensing toothpaste constructed and operable according to the teachings of the present invention. Apparatus 10 is shown in association with a conventional toothpaste containing tube 12 for dispensing toothpaste therefrom, tube 12 including a collapsible generally tubular shaped body portion 14 containing the toothpaste (not shown) having a first end 16 that is crimped or otherwise closed and an opposite second end 18 including a conventional outlet opening (not shown). Toothpaste tube 12 can be any of a wide variety of commercially available toothpaste tube constructions wherein the outlet opening is located in an externally threaded nipple or other member through which toothpaste is conventionally dispensed and which is adapted for threadedly receiving a conventional cap or other closure member (not shown).

Apparatus 10 includes a generally planar base member 20 of injected molded plastics or other substantially rigid construction having a first end 22 and an opposite second end 24. First end 22 of base member 20 includes a battery receptacle 26 adapted for receiving batteries 28 and a mounting arm 30 adapted for securing a gear motor 32 to the base member. Second end 24 of base member 20 includes an outwardly extending flange 34 supporting a nozzle 36 adapted for cooperatively receiving the nipple or other outlet member of second end 18 of toothpaste tube 12 for holding the tube in the position shown and dispensing the toothpaste therefrom. Base member 20 further includes elongated, parallel slots 38 and 40 therein extending between a location adjacent first end 16 spaced from nozzle 36 and a location adjacent nozzle 36, as better shown in FIG. 2.

Apparatus 10 further includes a pinch roller assembly 42 adapted and operable for collapsing toothpaste tube 12 for dispensing toothpaste therefrom. Pinch roller assembly 42 includes a hinged frame 44 rotatably supporting a pair of pinch rollers 46 and 48 in parallel, spaced relation. Hinged frame 44 of pinch roller assembly 42 is mounted for movement along base member 20 generally between a location as shown adjacent first end 22 thereof and a second location adjacent nozzle 36 corresponding to the respective opposite ends of slots 38 and 40. Frame 44 includes a pair of guide members 50 and 52 (FIG. 3) cooperatively receivable in the respective slots 38 and 40 and moveable therealong to guide the movement of the pinch roller assembly between the above discussed locations. Each pinch roller 46 and 48 is of injection molded plastics or similar generally rigid construction and has an outer cylindrical surface 54 extending around a central longitudinal axis 56 and including a plurality of spaced raised bumps 58 thereon. Pinch rollers 46 and 48 define a space 60 therebetween sufficiently large for receiving first end 16 of body portion 14 of toothpaste tube 12 as well as a substantial portion of the remainder of body portion 14 when in a generally collapsed state. Bumps 58 on outer cylindrical surfaces 54 of pinch rollers 46 and 48 are adapted to facilitate frictionally and/or mechanically engaging the outer surface of body portion 14 of toothpaste tube 12 for operational purposes, as will be explained.

Figure 2:
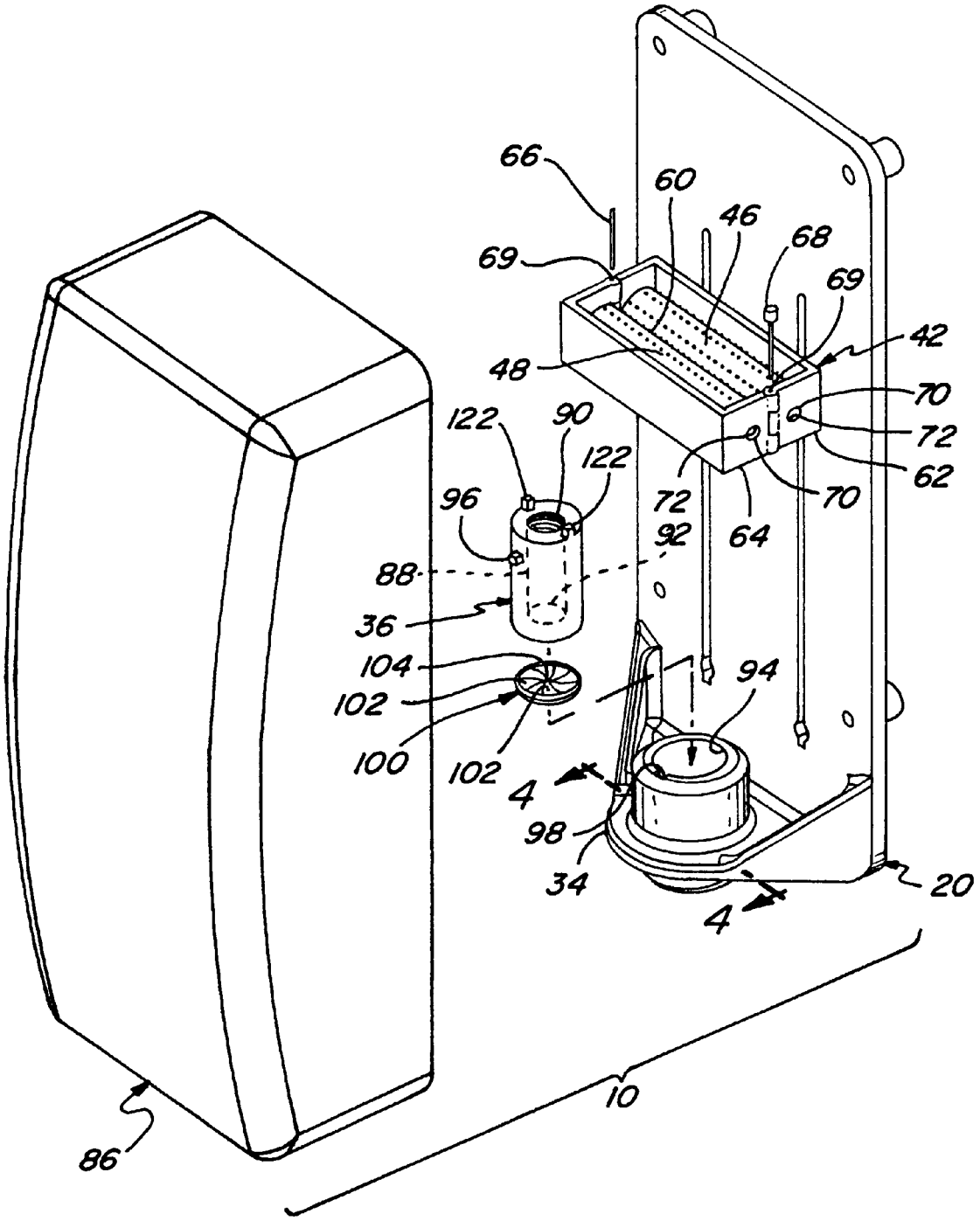
FIG. 2 is an exploded frontal perspective view of the apparatus of FIG. 1.
Figure 3:
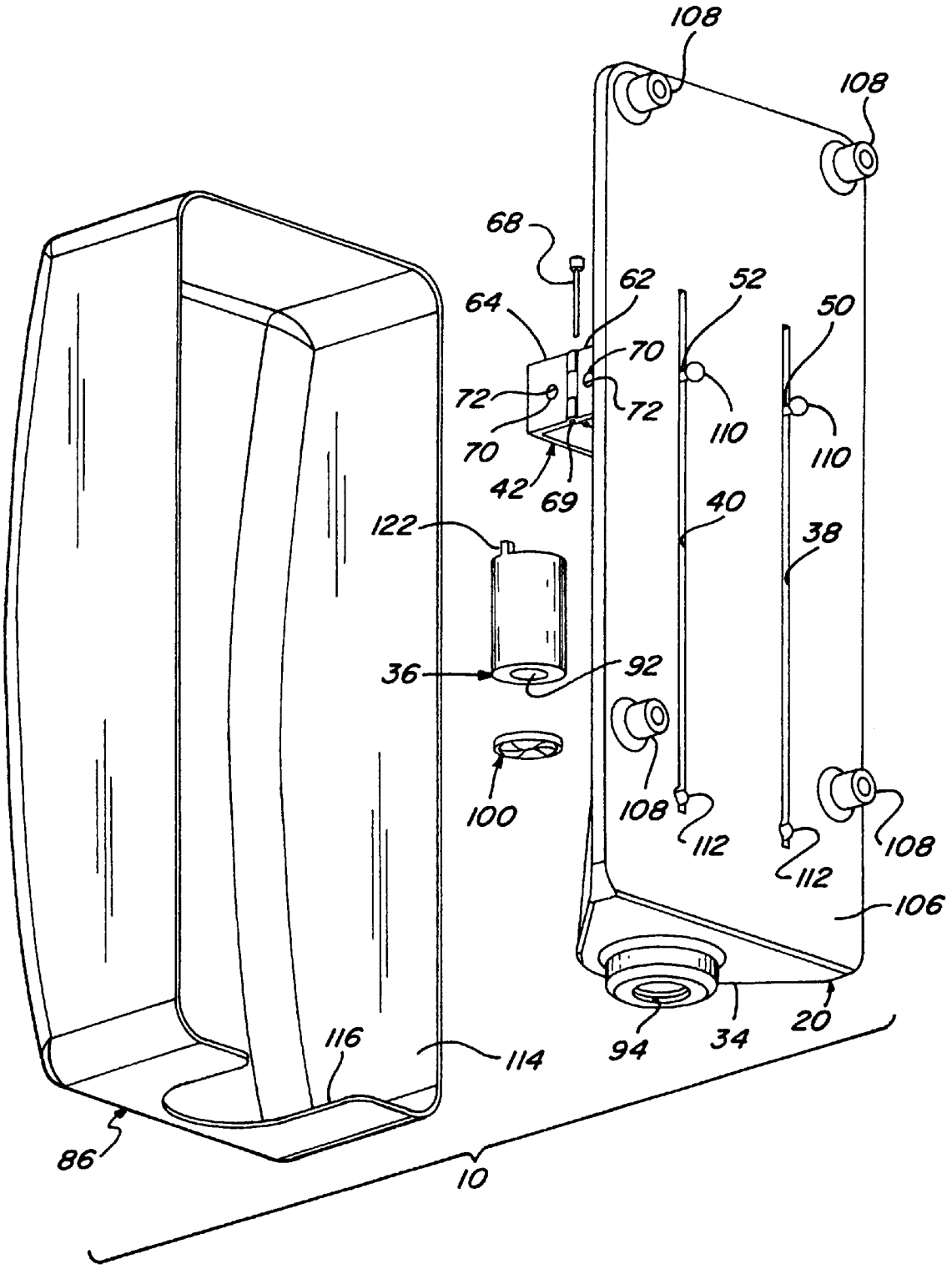
FIG. 3 is a rear exploded perspective view of the apparatus of FIG. 1.

Referring also to FIGS. 2 and 3, hinged frame 44 includes cooperatively engagable C-shaped member 62 and 64 which are each of injection molded plastics or similar construction hingedly joined together at their opposite ends with pins 66 and 68 positioned in aligned holes 69 therein to position rollers 46 and 48 in the above described spaced relation, one or both of pins 66 and 68 being singularly removable from its respective hole 69 to allow hingedly opening frame 44 to allow placement of a tube, such as toothpaste tube 12, in the space 60 between rollers 46 and 48. For rotatability, each pinch roller 46 and 48 includes opposed longitudinally extending shaft portions 70 concentric about axis 56 thereof, which shaft portions 70 are cooperatively and rotatably received in respective holes 72 in opposed ends of C-shaped frame members 62 and 64. One of the shaft portions 70 of a pinch roller, here pinch roller 46, is connected in rotatably driven communication with one end of an elongated rotatable drive cable 74 having an opposite end connected in rotatably driven communication with a rotatable output member 76 of gear motor 32. Drive cable 74 is preferably a commercially available device such as various models available from Stock Drive Products.

Gear motor 32 is a commercially available low voltage DC motor and gear drive assembly such as model 200 available from Autorol Corporation, Crystal Lake, Ill., and is connected to batteries 28 for receiving a direct voltage therefrom by wires 78 and 80. Alternatively, an external power source such as a conventionally available AC to DC converter providing a desired voltage to gear motor 32 from a household voltage source or the like could also be used as the power source. A SPST momentary contact switch 82 of conventional construction and operation is connected in electrical series with gear motor 32 to enable controlling operation thereof. Switch 82 is shown mounted atop a cover member 84 (shown here in phantom) to reveal the above identified components of apparatus 10. Cover member 84 is a generally rigid member of injection molded plastics construction and is sized and shaped to frictionally attach to base member 20 in covering relation to the apparatus as shown. Here also, cover member 84 is shown having a beveled end covering second end 24 of base member 20. However, it should be noted that cover member 84 can have a wide variety of other shapes and sizes adapted for a wide variety of applications, including, but not limited to, novelty shapes and the like (not shown).

Referring more particularly to FIG. 2, apparatus 10 is shown including an alternative more rectangular shaped cover member 86. Here also, toothpaste tube 12, battery receptacle 26, mounting arm 30, gear motor 32, drive cable 74, wires 78 and 80, and switch 82 are deleted to show the components of nozzle 36 and pinch roller assembly 42 with greater clarity. Nozzle 36 is a generally rigid cylindrical shaped member of injection molded plastics construction having an internal passage 88 communicating at one end with an internally threaded aperture 90 adapted for threadedly receiving the externally threaded nipple or other outlet member of second end 18 of toothpaste tube 12, as shown in FIG. 1, and at an opposite end with an aperture 92 from which toothpaste is dispensed. Nozzle 36 is cooperatively receivable in a marginally larger, cylindrical shaped receptacle 94 extending through flange 34 and includes a sidewardly extending tab 96 cooperatively receivable in a retainer notch 98 formed in flange 34 adjacent receptacle 94 for retaining and securing nozzle 36 in position in receptacle 94, as will be explained. A separate, replaceable closure member 100 is positionable in receptacle 94 in covering relation to aperture 92 of nozzle 36 for controlling the dispensing of toothpaste therethrough, closure member 100 being of generally flexible, injection molded plastics construction and including a plurality of radially inwardly extending tongues 102 resiliently positioned in closing relation to a central opening 104. In use, tongues 102 are biasable to an open position to allow the passage of toothpaste through central opening 104 under pressure exerted against tubular body portion 14 of toothpaste tube 12 by pinch rollers 46 and 48. After use, the tongues 102 resiliently return to their original positions in closing relation to central opening 104 when the pressure is relieved by the passage of toothpaste through the opening.

Turning to FIG. 3, a rear surface 106 of base member 20 is shown, the base member being mountable to a wall, mirror or other generally vertical surface with rear surface 106 in opposing relation thereto. A plurality of spaced feet 108 extend rearwardly from surface 106 a uniform distance for locating the rear surface in predetermined spaced relation to the mirror or other mounting surface, such that guide members 50 and 52 are freely movable in slots 38 and 40 of the base member. Here, it can be seen that guide members 50 and 52 each include a ball shaped detent 110 engageable with surface 106 adjacent opposite sides of the respective slots 38 and 40 for retaining pinch roller assembly 42 in desired relation to base member 20. Each of the slots 38 and 40 additionally includes an enlarged portion 112 at one end thereof adapted to allow the passage of a detent 110 therethrough to allow insertion of the guide members 50 and 52 in the respective slots, as well as the removal therefrom, as desired. FIG. 3 also shows C-shaped members 62 and 64 of assembly 42, pin 68 positioned for insertion in hole 69 thereof, shaft portions 70 located in holes 72 of the C-shaped portions, as well as flange 34 of the base member, receptacle 94 therein, and aperture 92 of nozzle 36 and closure member 100. Still further, FIG. 3 shows an inner cavity 114 of cover member 86 and a communicating opening 116 adapted for receiving receptacle 94 of flange 34 when the cover member is installed over the base member.

Figure 4:
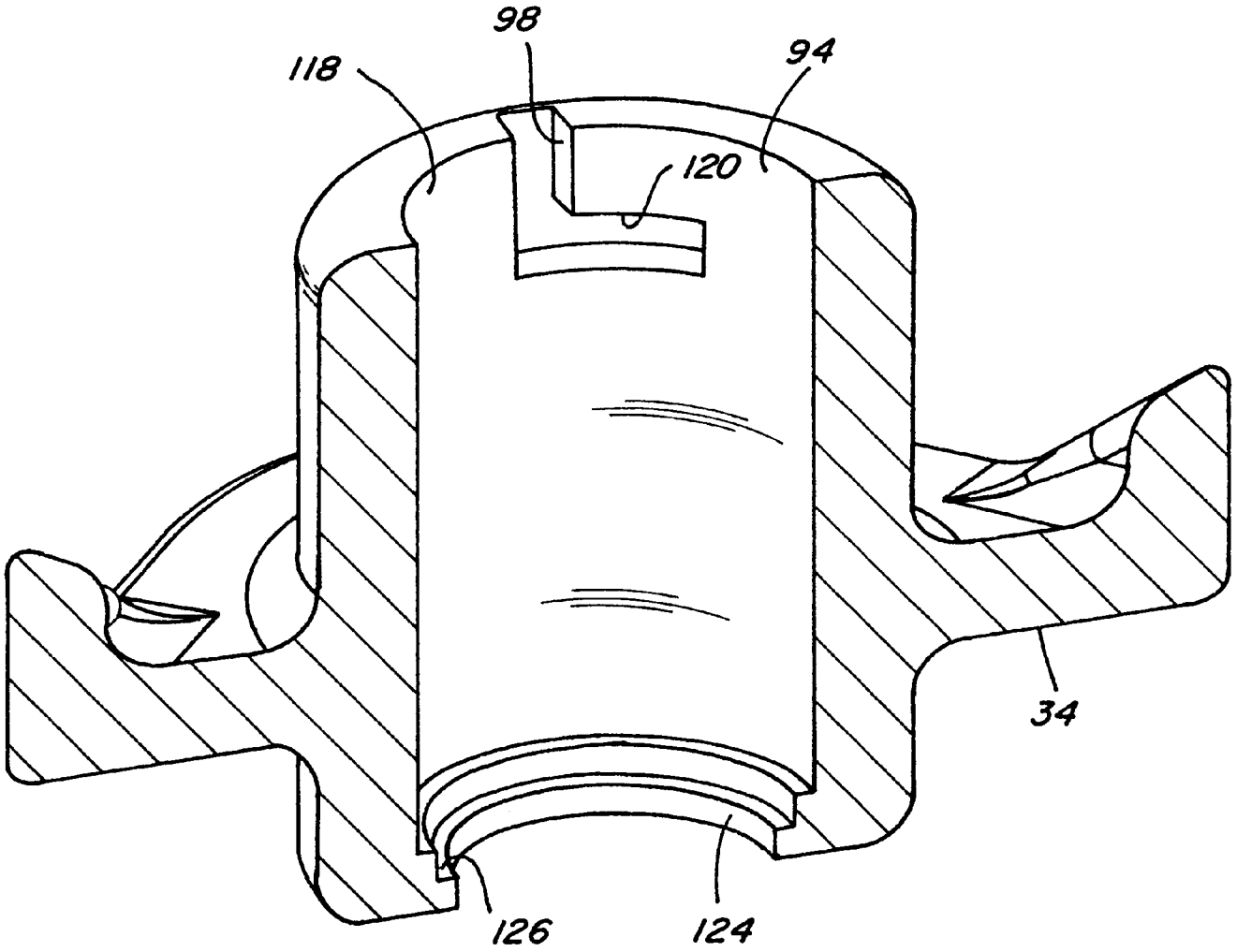
FIG. 4 is a cross-sectional view of the apparatus of FIG. 1 taken along line 4—4 of FIG. 2.

FIG. 4 is a cross sectional view of flange 34 showing receptacle 94 and notch 98 in communication therewith. Receptacle 94 includes a first open end 118 for cooperatively receiving nozzle 36, retainer notch 98 being located in open end 118 in position for receiving tab 96 on nozzle 36. Nozzle 36 can be inserted into receptacle 94 with tab 96 located in notch 98, and when fully received in the receptacle, the nozzle being rotatable to lockably position tab 96 in retainer portion 120 of the notch using endwardly extending tabs 122 of the nozzle (FIGS. 2 and 3). Receptacle 94 further includes an opposite open end 124 including an inner step 126 adapted for cooperatively receiving and holding closure member 100 in position beneath nozzle 36.

Figure 5:
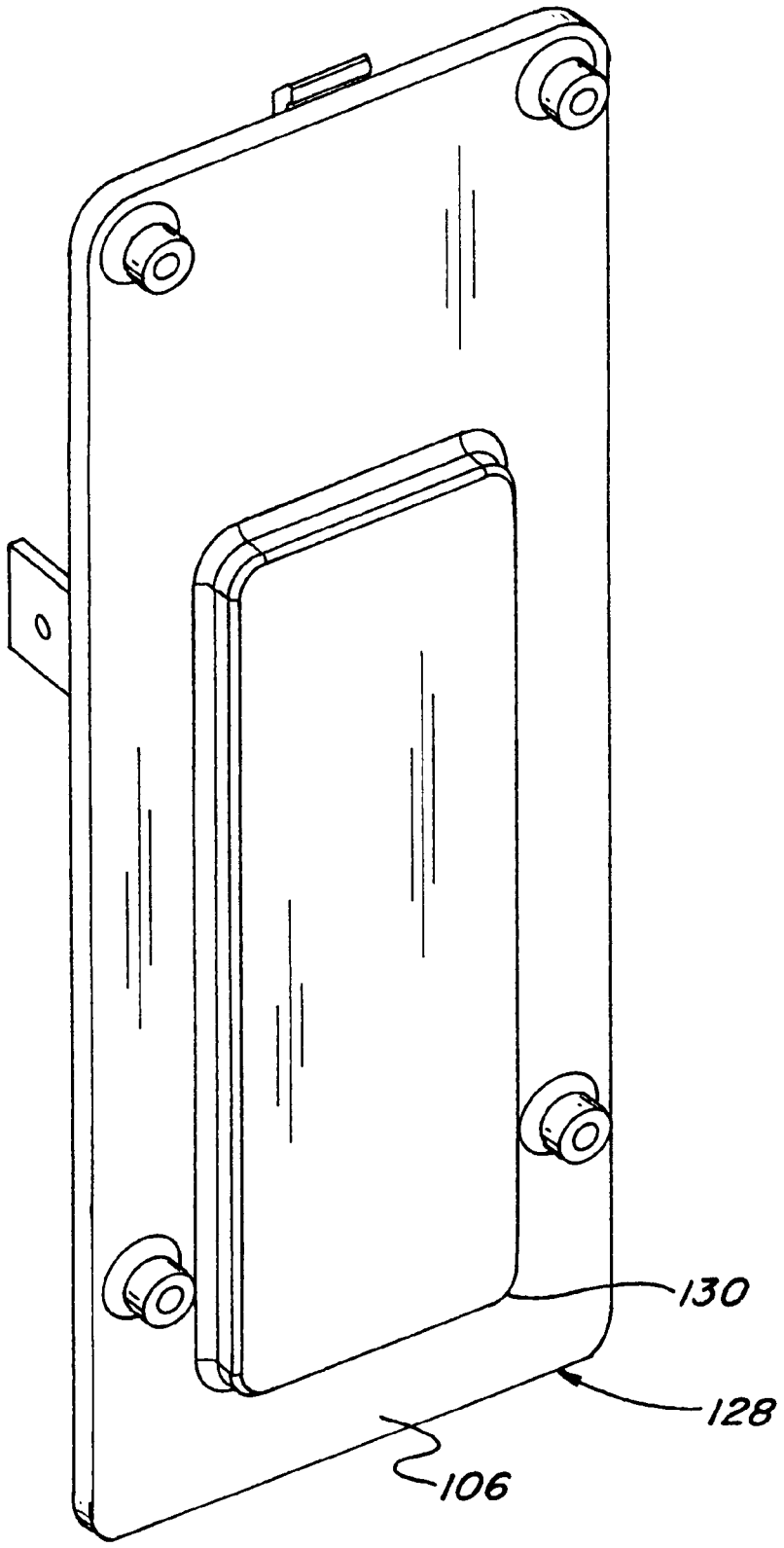
FIG. 5 is a rear perspective view of an alternative base member for the apparatus of FIG. 1.

Turning to FIG. 5, an alternative base member 128 for apparatus 10 is shown including a cover panel 130 in spaced parallel relation to rear surface 106 in covering relation to slots 38 and 40 (FIGS. 1–3). Cover panel 130 is operable to maintain base member 128 in desired spaced relation to a mounting surface such as a wall, mirror, or the like, and is also usable for attachment to the mounting surface using a suitable adhesive, a mechanical fastener or fasteners, or other suitable device or devices.

Figure 6:
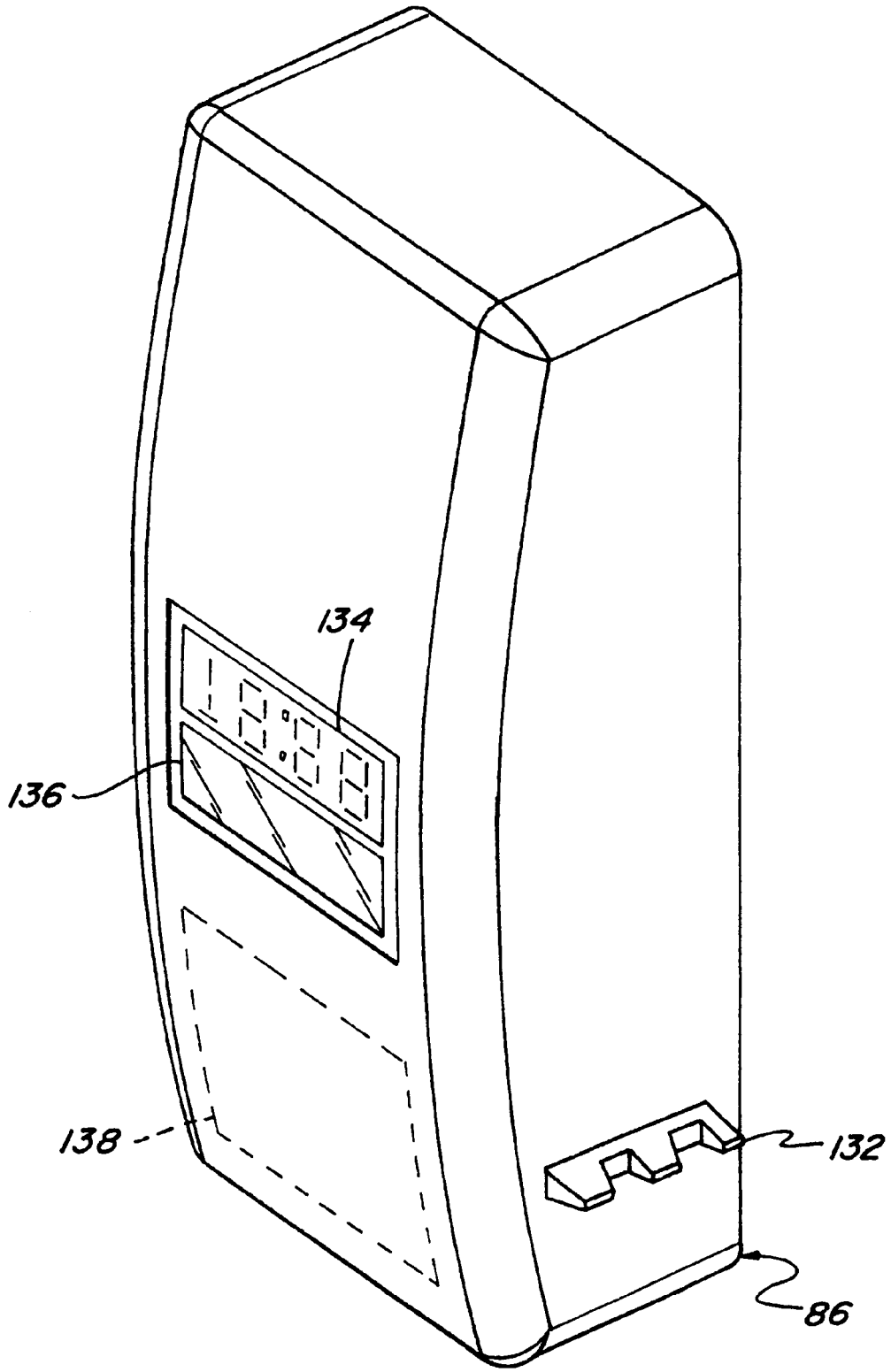
FIG. 6 is a perspective view of an alternative cover member for the apparatus of FIG. 1 including an optional toothbrush holder, clock and night light.

Referring to FIG. 6, apparatus 10 can additionally optionally include features such as a toothbrush holder 132 on the side as shown, or on any other suitable surface of cover member 84 or 86. Also, a clock 134 and/or a night light 136 constructed and operable in the conventional manner and energizable using any suitable power source such as batteries 28 can be provided on the outer surface of cover member 84 or 86, as shown. Still further, switch 82, or any other apparatus for energizing gear motor 32 can be provided at any suitable and convenient alternative location on apparatus 10, such as the area 138 depicted on the front cover 86, or elsewhere, such as beneath cover 84 or 86 adjacent aperture 92 of nozzle 36. Other contemplated features for apparatus 10 include holders for cups, dental floss, and other items typically associated with toothbrushing.

In operation, with a toothpaste tube installed in apparatus 10 as shown in FIG. 1, switch 82 can be momentarily operated to energize gear motor 32 to rotate pinch roller 46 so as to advance the pinch roller assembly a short distance along body portion 14 of toothpaste tube 12 towards nozzle 36 to thereby apply pressure against the tube to pressurize the toothpaste therein. The toothpaste, under pressure, then is dispensed from the tube through nozzle 36 and closure member 100, the pressure applied by the pinch roller assembly being sufficient to bias the tongues 102 of the closure member apart such that the toothpaste is able to flow therethrough. The toothpaste exiting the nozzle can then be received on a toothbrush (not shown) located beneath the nozzle in the conventional manner. When gear motor 32 is deenergized by releasing switch 82, pinch roller assembly 42 will stop its advance, pressurization within toothpaste tube 12 being relieved or reduced by the passage of the desired quantity of toothpaste from the tube. Thereafter, tongues 102 of closure member 100 will retain the toothpaste in the tube under any remaining pressurized condition that may be present within the toothpaste tube, as well as gravitational forces acting against the toothpaste.

Over time, as the toothpaste is dispensed from tube 12, pinch roller assembly 42 will gradually move along the tube closer to second end 18 of the tube. To accommodate this, drive cable 74 is sufficiently long and flexible, or can be coiled within the confines of cover member 84 or 86, so as to play out or move with the pinch roller assembly.

When it is desired to remove the toothpaste tube 12 and replace it with another tube, cover member 84 or 86 can be removed, pin 66 or 68 removed from hinged frame 44, and C-shaped members 62 and 64 swung apart. Tube 12 with nozzle 36 attached can be removed from flange 34 and the tube 12 threadedly disengaged from the nozzle and replaced with a new tube of toothpaste. Nozzle 36, with the new tube of toothpaste attached, can then be reinstalled in flange 34, pinch roller assembly 42 positioned adjacent first end 16 of the tube, hinged frame 44 closed and pin 66 or 68 reinstalled, and cover member 84 or 86 reinstalled, to resume operation.

An important feature and advantage of the present invention compared to prior known toothpaste dispenser constructions is the capability to manufacture and assemble the primary components thereof simply and inexpensively. In this regard, base member 20, including battery receptacle 26, mounting arm 30, flange 34 and slots 38 and 40, is preferably of injection molded, one piece plastics construction. Also, nozzle 36, the individual components of pinch roller assembly 42, and cover member 84 or 86 are preferably of injection molded plastics construction. The usage of flexible drive cable 74 for drivingly communicating gear motor 32 with driven pinch roller 46 is likewise a significant advantage over the know prior art constructions, due principally to its elimination of the need for complex gears, threaded shafts, and other power transmission means.

Thus, there has been shown and described a novel invention in apparatus for dispensing toothpaste which achieves many of the advantages set forth above. Many changes, modifications, variations and other uses and applications of the present apparatus, will, however, become apparent to those skilled in the art after considering this specification and the accompanying drawings. All such changes, modifications, variations, and other uses and applications which do not depart from the spirit and scope of the invention are deemed to be covered by the invention which is limited only by the claims which follow.

I claim:

1. Apparatus for dispensing toothpaste from an outlet opening at one end of a collapsible toothpaste containing tube, said apparatus comprising:

a base member having a nozzle adjacent a first end thereof, said nozzle having a passage therethrough, said nozzle being adapted for cooperatively receiving and holding said one end of said collapsible toothpaste containing tube with the outlet opening thereof located in registration with said passage for dispensing toothpaste from the tube therethrough;

a pinch roller assembly including a pair of pinch rollers each having a generally cylindrical outer surface extending around a central longitudinal axis, the pair of pinch rollers being mounted in parallel relation for rotation about the respective longitudinal axes thereof to a frame mounted to the base member for movement therealong between a location spaced from the nozzle and a location adjacent thereto, the pair of pinch rollers defining a space between the outer surfaces thereof adapted for receiving said toothpaste containing tube in a generally collapsed condition, the outer surface of at least a first of the pinch rollers being adapted for engaging the tube so as to be capable of moving along the tube when rotated;

a drive cable having one end connected in rotatably driving communication to the first pinch roller for rotating said first pinch roller about the axis thereof, the drive cable having an opposite end connected in rotatably driven communication with a gear motor, said gear motor being adapted for operative connection to a power source for rotatably driving said drive cable and said first pinch roller to move said first pinch roller and said pinch roller assembly along the toothpaste containing tube towards the nozzle for applying pressure against the tube and collapsing the tube to pressurize the toothpaste therein and dispense the toothpaste therefrom through the nozzle.

2. Apparatus, as set forth in claim 1, further comprising a battery power source operatively connected in electrical communication with said gear motor and a switch interposed between the battery power source and the gear motor for selectably operating the gear motor.

3. Apparatus, as set forth in claim 1, wherein said nozzle further comprises an internally threaded aperture adapted for threaded engagement with an external threaded portion extending around the outlet opening of the tube.

4. Apparatus, as set forth in claim 1, further comprising a closure member positioned for preventing the toothpaste to flow from the nozzle, the closure member being resiliently biasable to an open position by the toothpaste when pressurized to allow the flow of the toothpaste from the nozzle.

5. Apparatus, as set forth in claim 1, wherein the base member further comprises at least one slot therethrough extending between the location spaced from the nozzle and the location adjacent thereto, and the pinch roller assembly further comprises a member cooperatively receivable in the slot and engageable with an adjacent portion of the base member for guiding the movement of the pinch roller assembly along the base member.

6. Apparatus, as set forth in claim 2, further comprising a cover member attachable to the base member in covering relation to at least a substantial portion of the base member, the toothpaste containing tube, the pinch roller assembly, the drive cable and battery power source, the cover member including an opening positioned to be located in registration with the nozzle to allow the passage of the toothpaste therefrom, and the cover member accommodating the switch to allow external operation thereof.

7. Apparatus, as set forth in claim 1, wherein the frame of the pinch roller assembly is hingedly openable to allow placement of the toothpaste containing tube between the pinch rollers thereof and removal of the tube when a desired amount of the toothpaste therein has been dispensed.

8. Apparatus, as set forth in claim 5, wherein the at least one slot in the base member communicates with a cavity behind the base member adapted for receiving the member operable in the slot.

9. Apparatus, as set forth in claim 6, further comprising a clock on an external surface of the cover member.

10. Apparatus, as set forth in claim 6, further comprising a night light connected in electrical communication with the power source.

* * * * *